United States Patent [19]

Mack

[11] Patent Number: 4,752,658

[45] Date of Patent: Jun. 21, 1988

[54] PRESSURE CHECKED ELECTRICAL PRESSURE SWITCH

[75] Inventor: David C. Mack, Peoria, Ill.

[73] Assignee: Caterpillar Inc., Peoria, Ill.

[21] Appl. No.: 64,493

[22] Filed: Jun. 22, 1987

[51] Int. Cl.[4] ..... H01H 35/34

[52] U.S. Cl. ..... 200/82 R; 73/745; 200/83 P; 200/302.1

[58] Field of Search ..... 91/1; 92/5 R; 200/63 D, 200/63 DA, 82 R, 83 P, 83 Q, 83 J, 83 S, 83 SA, 83 W, 302.1, 302.2; 73/717, 723, 744, 745; 340/611, 614, 626; 307/118

[56] References Cited

U.S. PATENT DOCUMENTS

| | | | |
|---|---|---|---|
| 2,685,650 | 8/1954 | Collins | 200/83 W |
| 3,043,929 | 7/1962 | Guthrie | 200/83 J |
| 3,275,769 | 9/1966 | Weaver | 200/82 R |
| 3,379,841 | 4/1968 | Lombard | 200/82 R |
| 3,444,341 | 5/1969 | Mighton | 200/83 J |
| 4,297,552 | 10/1981 | Lavritsen | 200/83 P |
| 4,464,551 | 8/1984 | Johnson | 200/83 P |
| 4,614,849 | 9/1986 | Miller | 200/82 R |

*Primary Examiner*—G. P. Tolin

*Attorney, Agent, or Firm*—Terry D. Morgan

[57] ABSTRACT

An electrical pressure switch is used on a hydraulic system to indicate the presence of a minimum operating pressure. The hydraulic fluid acts on a piston to move the piston against a force exerted by a calibration spring. Movement of the piston ultimately closes the contacts of a switch, thereby delivering an electrical signal indicative of minimum operating pressure. A check valve moves in concert with the piston and isolates the internal structure of the pressure switch from escalating hydraulic pressure.

15 Claims, 3 Drawing Sheets

PRESSURE CHECKED ELECTRICAL PRESSURE SWITCH

DESCRIPTION

1. Technical Field

This invention relates generally to an electrical pressure switch and more particularly to an apparatus for protecting an electrical pressure switch from damage owing to excessive system pressures.

2. Background Art

In the field of hydraulic control systems it is common to monitor the hydraulic fluid to ensure that sufficient pressure is present for proper operation of the system. Such monitoring is normally accomplished by a hydraulic pressure switch configured to operate a set of electrical contacts at a preselected minimum pressure. Quite often, the minimum pressure necessary for operation of the system is modest in comparison to pressure spikes commonly experienced during normal operation. For example, a typical hydraulic steering circuit has sufficient pressure for operation at 25 psi, but regularly experiences operating conditions with pressures as high as 5000 psi.

It can be appreciated that precautions taken for properly sealing a 25 psi system are significantly less rigorous than those necessary for a 5000 psi system. Further, a switch designed to withstand high pressure spikes has significant accuracy problems at the low pressure switching point. These inaccuracies can be attributed to the durometer of the sealing membranes. For example, an o-ring sufficient for sealing a 25 psi system would be quickly destroyed when used on a 5000 psi system. However, while an o-ring of sufficient durometer to withstand the high pressure will have the desired sealing result, it will be relatively insensitive to low pressure variations. Moreover, a high durometer o-ring can be expected to increase hysteresis around the low pressure switching point.

The present invention is directed to overcoming one or more of the problems as set forth above.

DISCLOSURE OF THE INVENTION

In one aspect of the present invention, an electrical pressure switch is provided for detecting a minimum operating pressure of a hydraulic system. The electrical pressure switch is comprised of piston means for moving between first and second preselected positions in response to detecting a preselected pressure, means for switching between first and second conductive states in response to movement of the piston means between the first and second preselected positions, and means for fluidicly isolating the piston means from the hydraulic system in response to movement of the piston means from the first to the second preselected positions.

In another aspect of the present invention, an electrical pressure switch is provided for detecting a minimum operating pressure of a hydraulic system. The electrical pressure switch is comprised of a housing having first and second end portions, and a bore of a preselected diameter opening onto the first end portion, a piston having first and second end portions and being disposed within the housing bore adjacent the housing first end portion, the piston first and second end portions having preselected diameters respectively greater than and less than the bore opening diameter, the piston first end portion being in fluid communication with the hydraulic system, a plunger having first and second end portions and being disposed within the housing adjacent the housing second end portion, the plunger first end portion being in contacting relation with the piston second end portion, a calibration spring disposed about the plunger and adapted for biasing the plunger in a direction toward the piston, and a switch connected to and adapted for operation by movement of the plunger over a preselected distance.

In another aspect of the present invention, an electrical pressure switch is provided for detecting a minimum operating pressure of a hydraulic system. The electrical pressure switch is comprised of a housing having first and second end portions, and a bore of a preselected diameter opening onto the first end portion, a piston having first and second end portions and being disposed within the housing bore adjacent the housing first end portion, the piston first end portion being in fluid communication with the hydraulic system, a plunger having first and second end portions and being disposed within the housing adjacent the housing second end portion, the plunger first end portion being in contacting relation with the piston second end portion, a calibration spring disposed about the plunger and adapted for biasing the plunger in a direction toward the piston, a check valve having a ball in contact and moveable with the piston between an open and closed position; and a switch connected to and adapted for operation by movement of the plunger over a preselected distance.

Electrical pressure switches intended for detecting minimum operating pressure of hydraulic systems have heretofore suffered damage and corresponding problems owing to repeated exposure to high pressure spikes. It is desirable to provide a system which is impervious to high pressure spikes but retains accuracy at the low pressure switching points.

BRIEF DESCRIPTION OF THE DRAWINGS

For a better understanding of the present invention, reference may be had to the accompanying drawings, in which.

BEST MODE FOR CARRYING OUT THE INVENTION

Figure 1:
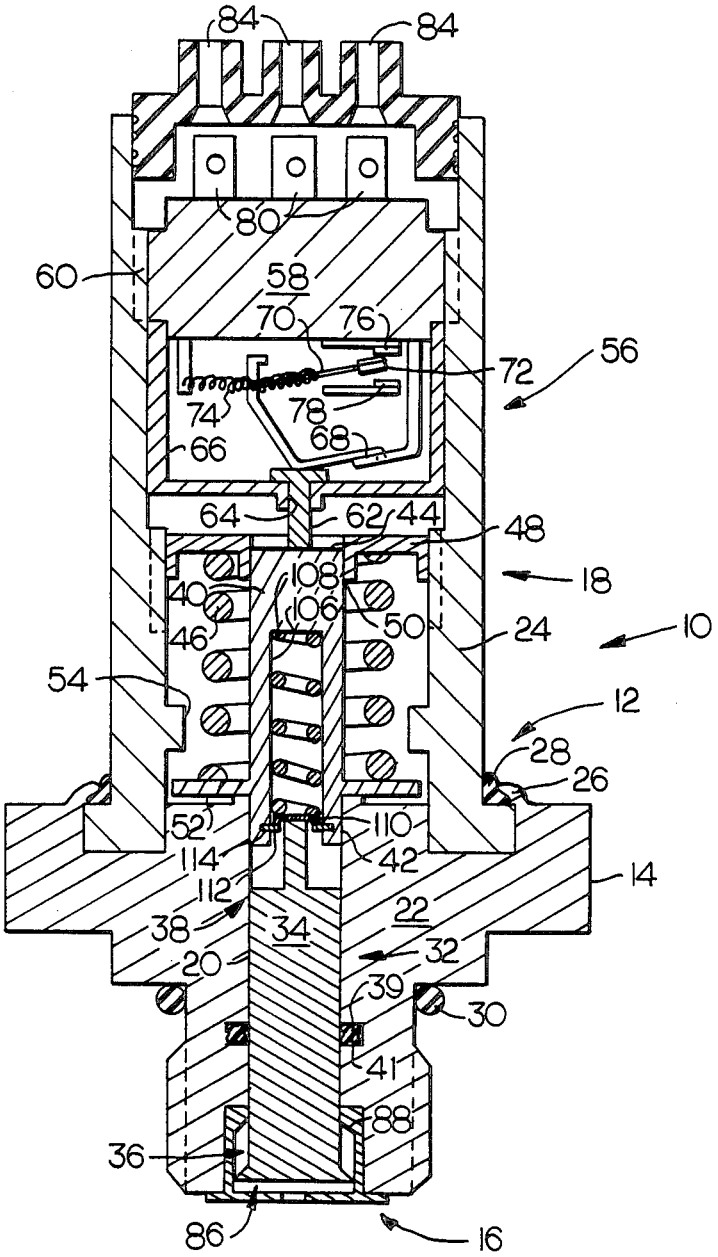
FIG. 1 illustrates a diagrammatic cross sectional view of one embodiment of the pressure checked pressure switch.

Referring now to the drawings, wherein a preferred embodiment of the present apparatus 10 is shown, FIG. 1 illustrates an electrical pressure switch 12 for detecting a minimum operating pressure of a hydraulic system. The apparatus 10 includes a housing 14 with first and second end portions 16,18, and a bore 20 of a preselected diameter opening onto the first end portion 16. The housing 14 consists of separate lower and upper housings 22,24 to facilitate the manufacturing process. The lower housing 22 forms the first end portion 16 of the housing 14 and is joined to the upper housing 24 via a machined crimp 26. This joint also includes an elastomeric o-ring 28 to prevent ingress of moisture into the housing 14. Additionally the first end portion 16 of the housing 14 is threaded, such that, the apparatus 10 can be hydraulically connected to the hydraulic system via a similarly threaded port (not shown). An elastomeric o-ring 30 is also disposed about the first end portion 16 to aid in sealing the hydraulic system. An elastomeric o-ring 39 is disposed within an annular recess 41 extending about the periphery of the bore 20 and generally prevents hydraulic fluid leakage into the pressure switch 12. The o-ring 39 is preferably of a quadrature cross sectional configuration to improve sealing capabilities and has a low durometer to prevent interference with movement of the piston 34. However, the flexibility of the quadrature o-ring 39 exacerbates the pressure switch's susceptibility to pressure damage. For example, a low durometer o-ring can be extruded into the space between the piston 34 and bore wall 20 by high pressure spikes. As will be discussed later, means must be provided to protect the pressure switch 12 from high pressure variations.

The apparatus 10 further includes piston means 32 for controllably moving between first and second preselected positions in response to detecting a preselected pressure. The piston means 32 includes a piston 34 having first and second end portions 36,38 and being disposed within the housing bore 20 adjacent the housing first end portion 16. The piston first end portion 36 is in fluid communication with the hydraulic system, such that, the pressure of the fluid acts on the first end portion 36 to urge the piston in a direction toward the housing second end portion 18.

A plunqer 40 has first and second end portions 42,44 and is disposed within the housing 14 adjacent the housing second end portion 18. The plunger first end portion 42 is in contact with the piston second end portion 38 and moves in conjunction with movement of the piston 34. A calibration spring 46 is disposed about the plunger 40 and biases the plunger 40 in a direction toward the piston 34. Accordingly, the fluid pressure applied to the piston first end portion 36 will effect movement of the piston 34 and plunger 40 only if the fluid force is sufficient to overcome the spring force. Further, the spring force is adjustable via a calibration screw 48. The internal bore of the upper housing 24 is threaded in like manner to that of the calibration screw 48.

The screw 48 adjustably engages the threaded portion of the upper housing 24 and receives one end of the calibration spring 46. The screw 48 also includes a central bore 50 coaxial with the plunger 40, thereby allowing the plunger 40 to pass through the screw 48 in response to compression of the spring 46. Thus, the compression of the spring 46 is controllably adjusted by altering the position of the screw 48 relative to the upper housing 24. For example, displacing the screw 48 in a direction toward the housing first end portion 16 further compresses the spring 46 and increases the force applied to the plunger 40. Thus, the fluid force necessary to move the piston 34 is increased. Careful adjustment of the calibration screw 48 and selection of calibration spring 46 allows the piston 34 and plunger 40 to move in response to the fluid force attaining a preselected setpoint.

The spring 46 applies force to the plunger 40 through a radial flange 52 positioned about and connected to the plunger 40 adjacent the first end portion 42. One end of the spring 46 contacts the surface of the flange 52 urging the plunger toward the piston 34. The flange 52 also serves the dual purpose of preventing overtravel of the plunger 40. A stop 54 extends radially inward from the upper housing 24 bore to form a restriction having a diameter less than the diameter of the flange 52. Therefore, movement of the plunger 40 in a direction toward the housing second end portion 18 is limited by contact between the flange 52 and stop 54.

Means 56 switches between first and second conductive states in response to movement of the piston means 32 between the first and second preselected positions. The means 56 serves to provide an electrical indication of the hydraulic pressure exceeding the preselected setpoint. Likewise, means 56 provides an indication of the hydraulic pressure dropping below the preselected setpoint to indicate loss of system hydraulic pressure. The means 56 includes a standard single pole double throw switch 58 connected to and adapted for operation by movement of the plunger 40 over a preselected distance. The switch 58 includes a threaded portion 60 which corresponds to a threaded portion of the upper housing 24 bore. The switch 58 is securely threaded into the upper housing 24 such that a push button 62 of the switch 58 contacts the plunger 40. The push button 62 extends through an opening 64 in the switch housing 66 and is biased in a direction toward the plunger 40 by a leaf spring arrangement 68. An overcenter link 70 is pivotally connected to the leaf spring 68 at one end and carries a contact 72 at the opposite end. A coil spring 74 is fixedly connected between the housing 66 and the center of the overcenter link 70. The switch 58 is shown in the unactuated state with the contact 72 electrically connected to a first contact 76. When actuated the push button 62 moves toward the second end portion 18, forcing the leaf spring 68 and the pivotal end of the overcenter link 70 in the same direction. Once the pivotal end of the overcenter link 70 moves past the center of the overcenter link 70, the spring 74 will urge the link 70 toward a second contact 78.

Electrical connectors 80 for the switch 58 are located at the proximal end of the second housing 24 adjacent the second end portion 18. A plug formed of organic plastic seals the second end portion 18 from moisture ingress, but retains three passages 84 for electrical wiring to the corresponding connectors 80. The condition of the pressure switch 12 is electrically monitored by providing a known voltage to the center contact 72 via the appropriate connector 80. The voltage levels of the two remaining connectors 80 are used to determine the condition of the pressure switch 12. For example, if the preselected voltage is also present on the contact 76 and its corresponding connector 80, system pressure can be assumed to be below the preselected setpoint. Conversely, if the voltage is present on the contact 78 and its corresponding connector 80, system pressure can be assumed to be above the preselected setpoint.

To prevent excessive pressures from being communicated to the pressure switch 12, means 86 fluidicly isolates the piston means 32 from the hydraulic system in response to movement of the piston means 32 from the first to the second preselected position. Absent the means 86, the pressure switch 12 is subject to damage from high pressure spikes typically found in hydraulic systems. In the preferred embodiment the piston means 32 includes the piston first and second end portions 36,38 having preselected diameters respectively greater than and less than the bore opening diameter. This arrangement seals the switch 12 by obstructing the fluid path after the preselected setpoint pressure has been reached. The housing bore 20 has a seat 88 disposed about the periphery of the bore 20 at the housing first end portion 16. The seat 88 is adapted to receive the first end portion 36 of the piston 34 in a sealing relationship. Both the seat 88 and the piston first end portion 36 have substantially similar cross sectional configurations such that a system pressure above the desired setpoint forces the piston 34 and plunger 40 to compress the calibration spring 46 and actuate the switch 58. Continued movement of the piston 34 results in the matching surfaces of the seal 88 and piston first end portion 36 contacting and preventing further increase of the hydraulic pressure within the pressure switch 12. Accordingly, variations in system pressure above the preselected setpoint pressure have no effect on the piston means.

Figure 2:
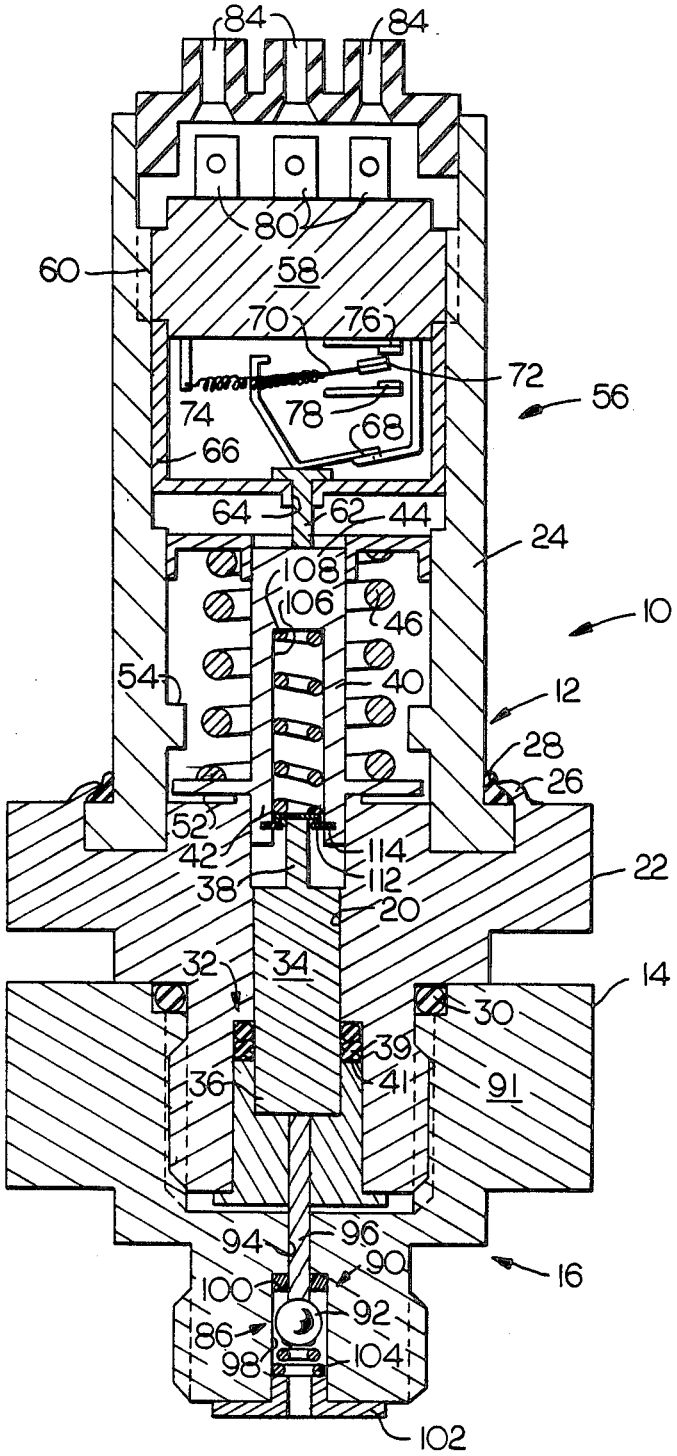
FIG. 2 illustrates a diagrammatic cross sectional view of another embodiment of the pressure checked pressure switch.
Figure 3:
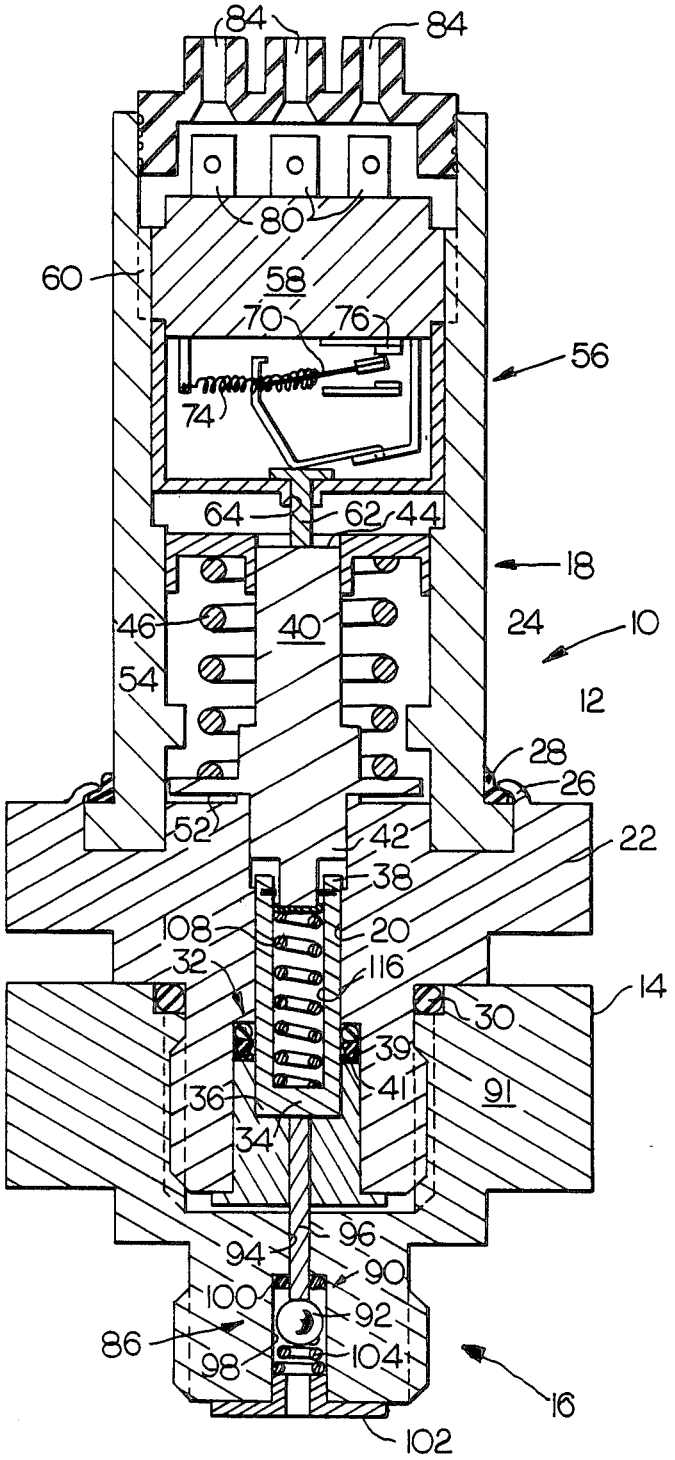
FIG. 3 illustrates a diagrammatic cross sectional view of another embodiment of the pressure checked pressure switch.

An alternate embodiment of the means 86 is illustrated in FIGS. 2 and 3 and shows a substitute structure for fluidicly isolating the piston means 32 from the hydraulic system. A check valve 90 is illustrated contained within an additional housing 91 and threadably connected to the lower housing 22. The check valve 90 includes a ball 92 in contact and moveable with the piston 34 between an open and closed position. A bore 94 having a diameter less than the diameter of the piston 34 is coaxially positioned with the piston bore 20 immediately adjacent the housing first end portion 16. A rod 96 is connected to the piston 34 and passes through the bore 94 contacting the ball 92. The ball 92 is retained within a bore 98 having a diameter greater than the rod bore 94 diameter and coaxially positioned with the rod bore 94. The intersection of the bores 94,98 forms a seat 100 for the ball 92. A pressure sufficient to overcome the calibration spring 46 forces the piston 34, rod 96, and ball 92 toward the housing second end portion 18 and the ball 92 contacts the seat 100 and seals the pressure switch 12.

A ball retainer 102 is press fitted and staked into the check valve bore 98. The ball retainer 102 prevents the ball 92 from being drawn out of the pressure switch 12 by severe pressure variations in the hydraulic system. The retainer 102 also supports a spring 104 disposed in contact with the ball 92 and adapted for urging the ball 92 in a direction toward the piston 34. The spring 104 is preferably of the conical variety to provide constant force throughout the range of motion. The spring 104 aids to in maintaining the ball 92 in a sealing relationship with the seat 100 especially under vibratory conditions. Further, since the hydraulic fluid pressure acts on the piston 34 to cause movement, the spring 104 ensures that the ball 92 and rod 96 follow the piston 34 and properly seal the pressure switch 12.

It is advantageous to provide means to prevent damage to the switch 58 in the event of overtravel. For example, should the position of the stop 54 not coincide with the travel limits of the switch 58, it is possible to damage the switch 58 by movement of the piston 34 and plunger 40 beyond the actuation point of the switch 58. Accordingly, the embodiments of FIGS. 1 and 2 include the plunger 40 having a bore 106 opening onto the plunger first end portion 42 and an overtravel spring 108 disposed within the plunger bore 106 in contact with the piston second end portion 38. The overtravel spring 108 is adapted for urging the piston 34 and plunger 40 in opposite directions toward the housing first and second end portions 16,18 respectively. A spring cup 110 is fitted to the end of the overtravel spring 108 and receives the piston second end portion 38. A snap ring 112 is disposed within an annular groove 114 extending about the periphery of the bore 106 to retain the spring 108 and spring cup 110 within the bore 106. The piston second end portion 38 includes a region immediately adjacent the end of the piston which has a diameter less than the opening provided by the snap ring 112. The piston second end portion 38 passes through the snap ring opening and contacts the spring cup 110 whereby the overtravel spring 108 can be compressed by further movement of the piston 34 after the plunger 40 has contacted the stop 54. The overtravel and calibration spring 108,46 each have a preselected spring preload with the preload of the overtravel spring 108 being greater than the preload of the calibration spring 46. This arrangement allows the calibration spring 46 to properly collapse under the preselected fluid force, but allows the overtravel spring 108 to compensate and properly seat the piston 34 to isolate the pressure switch 12 from the hydraulic system.

An alternate arrangement is illustrated in FIG. 3 and provides a similar function by reversing the parts to place the overtravel spring 108, spring cup 110, and snap ring 112 within a bore 116 in the piston 34. It can be appreciated that the operation is substantially identical to that illustrated in conjunction with FIGS. 1 and 2 and need not be described further herein.

Industrial Applicability

In the overall operation of the apparatus 10, assume that the pressure switch 12 is installed on a hydraulic steering circuit of a large industrial vehicle. The pressure switch 12 is used to operate a visual warning lamp when the system pressure is inadequate to operate the steering system. In the preferred embodiment of FIG. 1, the hydraulic pressure acts directly on the first end portion 36 of the piston 34. This force urges the piston 34 against the plunger 40 and attempts to compress the calibration spring 46. Obviously, compression of the spring 46 cannot be achieved until the hydraulic force exceeds the spring applied force.

During this period of low pressure below the preselected setpoint pressure, hydraulic fluid enters the bore 20 about the piston 34 but is isolated from the remainder of the pressure switch 12 by the quadrature o-ring 39. The o-ring 39 is sufficient for preventing fluid leakage at these low pressures, but can be damaged by high pressure.

As the system pressure increases and exceeds the preselected setpoint pressure, the fluid force acting on the piston 34 ultimately overcomes the spring force moving the piston 34 and plunger 40 toward the second end portion 18 of the housing 14. The plunger 40 actuates the switch 58 electrically indicating that minimum operating pressure has been reached. The plunger 40 will continue to move until engaging the stop 54. At this time the plunger first end portion 36 has engaged the seat and successfully isolated the pressure switch 12 from damaging high pressures. However, the plunger first end portion is still exposed to the hydraulic system pressure, such that, should the pressure fall below the preselected setpoint pressure, the piston is free to be moved by the calibration spring 46 toward the housing first end portion 16. Such movement will necessarily actuate the switch 58 in the opposite condition to energize the warning lamp and indicate insufficient pressure.

Other aspects, objects, and advantages of this invention can be obtained from a study of the drawings, the disclosure, and the appended claims.

I claim:

1. An electrical pressure switch for detecting a minimum operating pressure of a hydraulic system, comprising:

piston means for moving between first and second preselected positions in response to detecting a preselected pressure;

means for switching between first and second conductive states in response to movement of the piston means between the first and second preselected positions; and means for fluidicly isolating the piston means from the hydraulic system in response to movement of the piston means from the first to the second preselected positions;

wherein the piston means includes a housing having first and second end portions, and a bore of a preselected diameter opening onto the first end portion, a piston having first and second end portions and being disposed within the housing bore adjacent the housing first end portion, the piston first end portion being in fluid communication with the hydraulic system, a plunger having first and second end portions and being disposed within the housing adjacent the housing second end portion, the plunger first end portion being in contacting relation with the piston second end portions; wherein the isolating means includes the piston first and second end portions having preselected diameters respectively greater than and less than the bore opening diameter, and the hosuing bore having seat disposed about the periphery of the bore at the first end portion of the housing, the seat receiving the first end portion of the piston in a fluid sealing relationship upon an overpessure condition.

2. An electrical pressure switch, as set forth in claim 1, wherein the switching means includes a switch connected to and adapted for operation by movement of the plunger over a preselected distance.

3. An electrical pressure switch for detecting a minimum operating pressure of a hydraulic system, comprising:

a housing having first and second end portions, and a bore of a preselected diameter opening onto the first end portion;

a piston having first and second end portions and being disposed within the housing bore adjacent the housing first end portion, the piston first and second end portions having preselected diameters respectively greater than and less than the bore opening diameter, the piston first end portion being in fluid communication with the hydraulic system;

a plunger having first and second end portions and being disposed within the housing adjacent the housing second end portion, the plunger first end portion being in contacting relation with the piston second end portion;

a seat disposed about the periphery of the bore at the first end portion of the housing, the seat being adapted for receiving the first end portion of the piston in a sealing relationship to prevent leakage from the hydraulic system into the housing;

a calibration spring disposed about the plunger and adapted for biasing the plunger in a direction toward the piston; and a switch connected to and adapted for operation by movement of the plunger over a preselected distance;

and wherein the piston includes a bore opening onto the piston second end portion and an overtravel spring disposed within the piston bore and in contact with the first end portion of the plunger, the overtravel spring being adapted for urging the piston and plunger in opposite directions toward the housing first and second end portions respectively.

4. An electrical pressure switch, as set forth in claim 3, wherein the plunger includes a bore opening onto the plunger first end portion and an overtravel spring disposed with the plunger bore in contact with the second end portion of the piston, the overtravel spring being adapted for urging the piston and plunger in opposite directions toward the housing first and second end portions respectively.

5. An electrical pressure switch, as set forth in claim 4, wherein the overtravel and calibration spring each have a preselected spring preload with the preload of the overtravel spring being greater than the preload of the calibration spring.

6. An electrical pressure switch, as set forth in claim 3, wherein the overtravel and calibration spring each have a preselected spring preload with the preload of the overtravel spring being greater than the preload of the calibration spring.

7. An electrical pressure switch for detecting a minimum operating pressure of a hydraulic system, comprising:

a housing having first and second end portions, and a bore of a preselected diameter opening onto the first end portion;

a piston having first and second end portions and being disposed within the housing bore adjacent the housing first end portion, the piston first end portion being in fluid communication with the hydraulic system;

a plunger having first and second end portions and being disposed within the housing adjacent the housing second end portion, the plunger first end portion being in contacting relation with the piston second end portion;

a calibration spring disposed about the plunger and adapted for biasing the plunger in a direction toward the piston;

a check valve having a ball in contact and moveable with the piston between an open and closed position; and a switch connected to and adapted for operation by movement of the plunger over a preselected distance.

8. An electrical pressure switch, as set forth in claim 7, wherein the plunger includes a bore opening onto the plunger first end portion and an overtravel spring disposed within the plunger bore in contact with the second end portion of the piston, the overtravel spring being adapted for urging the piston and plunger in opposite directions toward the housing first and second end portions respectively.

9. An electrical pressure switch, as set forth in claim 8, wherein the overtravel and calibration spring each have a preselected spring preload with the preload of the overtravel spring being greater than the preload of the calibration spring.

10. An electrical pressure switch, as set forth in claim 7, wherein the piston includes a bore opening onto the piston second end portion and an overtravel spring disposed within the piston bore and in contact with the first end portion of the plunger, the overtravel spring being adapted for urging the piston and plunger in opposite directions toward the housing first and second end portions respectively.

11. An electrical pressure switch, as set forth in claim 10, wherein the overtravel and calibration spring each have a preselected spring preload with the preload of the overtravel spring being greater than the preload of the calibration spring.

12. An electrical pressure switch, as set forth in claim 7, wherein the check valve includes a spring disposed in contact with the ball and adapted for urging the ball in a direction toward the piston.

13. An electrical pressure switch, as set for in claim 12 wherein the check valve spring is a conical spring.

14. An electrical pressure switch for detecting a minimum operating pressure of a hydraulic system, comprising:

piston means for moving between first and second preselected positions in response to detecting a preselected pressure;

means for switching between first and second conductive states in response to movement of the piston means between the first and second preselected positions; and means for fluidicly isolating the piston means from the hydraulic system in response to movement of the piston means from the first to the second preselection; and wherein the piston means includes a housing having first and second end portions, and a bore of a preselected diameter opening onto the first end portion, a piston having first and second end portions and being disposed within the housing bore adjacent the housing first end portion, the piston first end portion being in fluid communication with the hydraulic system, a plunger having first and second end portions and being disposed within the housing adajcent the housing second end portion, the plunger first end portion being in contacting relation with the piston second end portion; wherein the isolating means includes a check valve having a ball in contact and movable with the piston between an open and closed position.

15. An electrical pressure switch, as set forth in claim 14, wherein the switching means includes a switch connected to and adapted for operation by movement of the plunger over a preselected distance.

* * * * *